US005728264A

United States Patent [19]

Pangalos

[11] Patent Number: 5,728,264

[45] Date of Patent: Mar. 17, 1998

[54] AVOIDANCE OF SALT SCALING BY ACIDIC PULP WASHING PROCESS

[75] Inventor: George Pangalos, Plainsboro, N.J.

[73] Assignee: Union Camp Patent Holding, Inc., Wilmington, Del.

[21] Appl. No.: 547,820

[22] Filed: Oct. 25, 1995

[51] Int. Cl.[6] ..... D21C 9/02

[52] U.S. Cl. ..... 162/48; 162/65; 162/78; 162/89; 162/90

[58] Field of Search ..... 162/65, 76, 78, 162/149, 88, 89, 90, 48

[56] References Cited

U.S. PATENT DOCUMENTS

| | | | |
|---|---|---|---|
| 3,874,992 | 4/1975 | Liebergott | 162/66 |
| 4,283,251 | 8/1981 | Singh | 162/17 |
| 4,372,812 | 2/1983 | Phillips et al. | 162/40 |
| 4,975,150 | 12/1990 | Yasuda et al. | 162/199 |
| 5,352,332 | 10/1994 | Maples et al. | 162/30.1 |
| 5,401,362 | 3/1995 | Lindberg | 162/37 |
| 5,415,734 | 5/1995 | Backlund et al. | 162/65 |
| 5,462,641 | 10/1995 | Bergvist et al. | 162/40 |

FOREIGN PATENT DOCUMENTS

| | | |
|---|---|---|
| 1112813 | 1/1979 | Canada . |
| 2017807 | 5/1990 | Canada . |

OTHER PUBLICATIONS

Casey, James P., "Pulp and Paper—Chemistry and Chemical Technology" Third Edition, vol. 1, 1951.

Pulp & Paper Canada, vol. 79, No. 12, Dec. 1978, "Rapid press–caustic extraction in pulp bleaching sequences", by N. Lebergott et al.

Journal of Pulp and Paper Science: vol. 16, No. 6, Nov. 1990, "Effect of alkaline Extraction of Ozone–Bleached Pulp on Brightness and Bleachability", by C.A. Lindholm.

Paper JA PUU—Paper and Timber, vol. 74/No. 3, 1992, "Alkaline extraction of ozone–bleached pulp" by Carl–Anders Lindholm.

Nordic Pulp and Paper Research Journal, Part 2, No. 2/1992, "Alkaline extraction of ozone–bleach pulp", Carl–Anders Lindholm et al.

Paper JA PUU—Paper and Timber, vol. 74, No. 9, 1992, Part 3. The NaOH dose—"Alkaline extraction of ozone–bleached pulp", by Carl–Anders Lindholm.

Journal of Pulp and Paper Science, vol. 19, No. 3, May 1993, Part 4: Comparison of E, (EB), (EO), (EP) and (EOP) Treatment "Alkaline Extraction of Ozone–bleached Pulp", by C.A. Lindholm.

Nordic Pulp and Paper Research Journal No. 1/1994, Part 5, Chlorine dioxide bleaching after various extraction treatments—"Alakaline extraction of ozone–bleached pulp", by Carl–Anders Lindolm.

Nordic Pulp and Paper Research Journal No. 3/1994, "Alkaline extraction of ozonated kraft pulps", by Jonas Sundin and Nils Hartler.

Tappi Journal, Jan. 1992, "A survey of the use in bleaching pulps, Part 1", by Norman Leibergott et al.

Tappi Journal, Feb. 1992, "A survey of the use of ozone in bleaching pulps, Part 2", by Norman Liebergott.

(List continued on next page.)

*Primary Examiner*—Steven Alvo

*Attorney, Agent, or Firm*—Pennie & Edmonds

[57] ABSTRACT

The use of hot water extraction (pH 7–8, 165° F.) in place of an alkaline extraction in pulp bleaching sequences between an ozone delignification stage alkaline wash and a brightening stage allows higher strength pulp to be achieved at essentially the same brightness levels using reduced overall amounts of bleaching chemicals. In addition, effluents from pulp washing stages following these treatments can be recycled without generating scale in process equipment because the solubility of salts that could form such scale is significantly greater in these effluents.

21 Claims, 6 Drawing Sheets

OTHER PUBLICATIONS

Tappi Journal, Mar. 1992, "Delignification and bleaching of chemical pulps with ozone: a literature review", by Medwick V. Byrd, Jr. et al.

Pulp & Paper, Aug. 1993, "Proper Post-Treatment Ensures Ozone Belaching Efficiency, Selectivity", by J.L. Cododette et al.

International Pulp Bleaching Conference, "Improvement Of Ozone Prebleaching Of Kraft Pulps", by Dominique Lachenal et al.

1984 Pulping Conference, "Hot Water Treatment Of Chlorinated Pulp—Part 1", by R.M. Berry et al.

Journal of Pulp and Paper Science: vol.11, No. 5, Sep. 1985, "Hot-water treatment of Chlorinated Pulp—Part II", by R.M. Berry and B.I. Fleming.

Figure 4: Coupon Scaling in the Z-Washer Vat
Scaling Rate (g/m²/day)
30
25
20
15
10
5
0
1 2 3 4 5 6 7 8 9 10 11 12 13 14 15 16 17 18 19 20 21 22 23 24 25 26 27 28
GROUPS OF 3 SAMPLES (Sampled about a week apart)
Sample A
Sample B
Sample C

AVOIDANCE OF SALT SCALING BY ACIDIC PULP WASHING PROCESS

FIELD OF THE INVENTION

The invention relates to a method for preventing or minimizing the formation of scale from calcium or other insoluble or sparingly soluble salt precipitates in equipment used for washing and processing pulp during a bleaching sequence, especially where a countercurrent wash water effluent recycle strategy is utilized. The invention also relates to the use of a hot water extraction in various sequences for bleaching lignocellulosic materials and more particularly, to sequences which utilize the hot water extraction after an ozone delignification and prior to the final brightening.

BACKGROUND OF THE INVENTION

The processing of chemical and semi-chemical cellulosic pulps in the manufacture of various grades of paper and paper products generally requires that such pulps be subjected to several successive bleaching treatments. These bleaching treatments are optionally interspersed with various washing, dilution, extraction and/or concentration stages in order to arrive at a final product having a desired lignin content and a desired brightness.

It has been conventional for many years to delignify and bleach wood pulp with elemental chlorine ("C") and/or chlorine-containing compounds such as chlorine dioxide ("D"). This process is described, for example, in U.S. Pat. Nos. 1,957,937 to Campbell et al.; 2,975,169 to Cranford et al., and 3,462,344 to Kindron et al., as well as in the *Handbook For Pulp and Paper Technologists*—Chapter 11: Bleaching (§11.3), TAPPI, USA.

Although compounds such as those described above have proven to be effective bleaching agents, they suffer from several deficiencies, e.g., they are difficult to handle and they cause corrosion of the processing equipment within the mill. In addition, concern about the possible environmental effects of disposing of chlorine-containing effluents from pulp bleaching mills by sewering these effluents has led to significant changes in government requirements and permits for such mills. These new rules mandate more stringent standards for the handling of such effluents. Moreover, the recycle of these effluents is not in itself a satisfactory answer since the build-up of chlorides within the mill over time precludes the operation of such a closed system without employing recovery techniques requiring extensive, and therefore expensive, modifications.

In an effort to overcome these disadvantages, those working in this field have extensively examined numerous alternative bleaching processes designed to reduce or eliminate the use of elemental chlorine and chlorine-containing compounds from multi-stage bleaching processes for lignocellulosic pulps. These alternative processes utilize, for example, various combinations of oxygen ("O"), ozone ("Z"), alkaline extraction ("E") and peroxides ("P"), to name but a few of the chemicals used. Complicating these efforts, however, is the requirement that high levels of pulp brightness are necessary for many of the applications for which such pulp is to be used. The prior art processes which utilize these materials in various combinations are, however, often unable to achieve these high pulp brightness levels without an unacceptable loss in pulp strength, as evidenced by a corresponding decrease in viscosity of the pulp product.

One commercially successful chlorine-free bleaching sequence is disclosed in U.S. Pat. No. 5,164,043. This patent discloses a multi-stage process for delignifying and bleaching a lignocellulosic material. Initially, a pulp is formed from the lignocellulosic material by Kraft pulping, Kraft AQ pulping or extended delignification. The pulp is then partially delignified with oxygen preferably according to a modified alkaline addition technique where the alkaline material is substantially uniformly combined with the pulp at low consistency prior to removing pressate and forming a high consistency pulp which is then contacted with the oxygen. Next, the partially delignified pulp is treated with a chelating agent and an acid so that the pH is in the range of about 1 to 4, and the pulp is then further delignified with ozone. Preferably, the ozone stage is conducted on high consistency pulp utilizing a dynamic reactor which turbulently mixes the pulp with the ozone gas so that substantially all pulp particles are exposed to the ozone gas for reaction therewith. This enables the pulp to be substantially uniformly bleached, thus forming an intermediate pulp. When desired, this intermediate pulp can be further processed by an alkaline extraction step followed by a brightening step which uses chlorine dioxide or a peroxide compound. The intermediate pulp has a brightness of between about 35 and 80 GEB whereas the final brightened pulp has a brightness of between about 70 and 90 GEB.

While this patented process is highly effective, it has been found from commercial plant operation that calcium ions can precipitate on plant equipment under certain conditions and cause disruption of the throughput of the process. Thus, a way to prevent such precipitation is needed. Also, improvements in bleaching the pulp to high brightnesses while conserving bleaching or brightening chemicals or while increasing pulp strength are desirable for a variety of reasons. Thus, enhancements of the prior art would be desirable, and the present invention provides one such improvement.

SUMMARY OF THE INVENTION

The present invention relates to a method for reducing or eliminating the formation of salt scale upon process equipment in a pulp bleaching process due to pH shock caused by the presence of sparingly soluble salts, by subjecting the pulp to a bleaching sequence which includes a plurality of pulp treatment steps, wherein at least one pulp treatment step is conducted under acidic conditions to generate an acidic pulp stream; if necessary, adjusting the consistency of the acidic pulp stream to facilitate transport to subsequent pulp treatment steps; and washing the pulp stream with an aqueous wash solution having a pH which is not greater than the pH of the pulp stream to avoid pH shock and to remove at least some of said salts therefrom to thereby reduce or eliminate the formation of salt scale upon process equipment used for conducting one or more of the subsequent pulp treatment steps.

One embodiment of this method comprises adding caustic material to the acidic pulp prior to the washing step to generate a less acidic pulp stream. The caustic material is added under conditions effective to remove at least a portion of the lignin remaining in the pulp while not significantly reducing or while actually increasing the strength of the pulp. Caustic material may be added to the pulp stream as an alkaline solution in an amount effective to generate a neutral to alkaline pulp stream. Generally, caustic material is added to provide a pH of less than 10 and for no longer than about 30 to 60 minutes before the pulp stream is washed at a pulp stream temperature of no greater than about 165° F. Thus, the aqueous wash solution will have a pH which differs from that of the pulp stream by no more than about 5 units, preferably about 2 units or less and most preferably between about 0.5 and 1.5 units. Advantageously, the pH of the pulp stream is at least about 8 and the pH of the aqueous wash solution is about 7.

The method may include soaking the washed pulp to remove additional lignin therefrom prior to subjecting the pulp to a subsequent brightening treatment step. For cost considerations, the caustic material to be used is oxidized white liquor and the soaked pulp is washed to remove contaminants which would otherwise affect the efficiency of the brightening treatment step.

The bleaching sequence is preferably conducted in a closed bleach plant where substantially all wash water effluents or filtrates are countercurrently recycled, and at least one wash filtrate from washing the pulp after a subsequent pulp treatment stage is countercurrently recycled to wash the pulp stream. The acidic pulp treatment step preferably comprises an ozone treatment, and the acidic pulp stream can be washed in a washer utilizing wash filtrate from washing the pulp after a hot water extraction stage. In these sequences, the insoluble or sparingly soluble salts primarily comprise calcium or barium cations which generally enter the process from the pulp or the bleaching chemicals.

The present invention specifically provides novel combinations of delignification and bleaching steps which utilize a hot water extraction step between an acidic bulk delignification stage and the final brightening stage or stages. One aspect of the invention relates to a sequence for treating a lignocellulosic pulp with bleaching chemicals, which sequence includes an ozone delignification stage followed by a brightening stage. In this sequence, the pulp exiting the ozone delignification stage is treated with an alkaline solution having pH above 7 for a sufficient time and at a temperature of at least about 60° F. to form a pulp stream, followed by treatment of the pulp stream with an aqueous solution having a lower pH than the pulp stream before the pulp enters the brightening stage to avoid pH shock and to remove at least some sparingly soluble or insoluble salts therefrom to thereby reduce or eliminate the formation of salt scale upon process equipment used for conducting one or more of the pulp treatment steps that follow the alkaline solution pulp treatment step.

The sequence preferably comprises forming the pulp from a lignocellulosic material and increasing the brightness of the ozone delignified pulp in a brightening stage to obtain a pulp which is brightened to essentially the same brightness as a pulp which is subjected to the same sequence except where an alkaline extraction stage is used instead of the aqueous solution soak treatment.

For this embodiment, the alkaline solution treated pulp stream generally has a pH of about 7.5 to 11.5 and a temperature of about 90° to 125° F. and is conducted for a period of about 1 to 15 minutes, while the aqueous solution used for the soak treatment generally has a pH of about 5 to 9 and a temperature of about 100° to 200° F. Advantageously, oxidized white liquor is utilized for at least a portion of the alkaline solution, primarily due to considerations Of cost and availability in the bleach plant. In operation, the pH of the alkaline solution can be up to about 0.5 to 2 units higher than that of the aqueous solution, and the temperature of the aqueous solution treatment can be at least about 10° to 20° F. higher than that of the alkaline solution treatment.

Preferably, the ozone delignification stage is conducted on high consistency pulp and the brightening stage is conducted using a peroxide compound or chlorine dioxide. Also, the temperature of the aqueous treatment step may be achieved by the addition of a sufficient amount of steam, another component that is readily available in the plant.

After each of the alkaline and aqueous treatments, the pulp is washed, and at least some of the effluent from the latter washing step can be recycled to the former. In the preferred bleaching sequences, the pulp is partially delignifying with oxygen, then washed and acidified prior to the ozone delignification stage. At least some of the effluent from the washing of the pulp after the alkaline treatment is used for washing the pulp after the oxygen delignifying step. This reduces the amount of aqueous liquids utilized in the bleach plant.

If necessary, the amount of bleaching chemical in the brightening stage can be slightly increased to obtain a pulp which is brightened to essentially the same brightness as one which is subjected to the same sequence except where an alkaline extraction is used instead of the aqueous solution treatment. When this is done, the amount of chemical in the brightening stage may be increased by up to about 5 to 20% in order to obtain essentially the same brightness level as a bleaching sequence that utilizes an alkaline extraction instead of a hot water extraction. This additional amount of chemical compensates for the lesser amount of brightness increase in the hot water soak compared to an alkaline extraction stage, but does not reduce the strength of the bleached pulp as does the alkaline extraction. Moreover, the overall cost of the bleaching chemicals utilized in the sequence is reduced by following the present processes. Thus, the resultant bleached pulp strength is increased compared to bleached pulp produced by the sequence that utilizes an alkaline extraction step while achieving essentially the same brightness. The strength increase is primarily obtained because alkaline material is not applied to the pulp in the extraction stage.

DETAILED DESCRIPTION OF THE PREFERRED EMBODIMENTS

Figure 1:
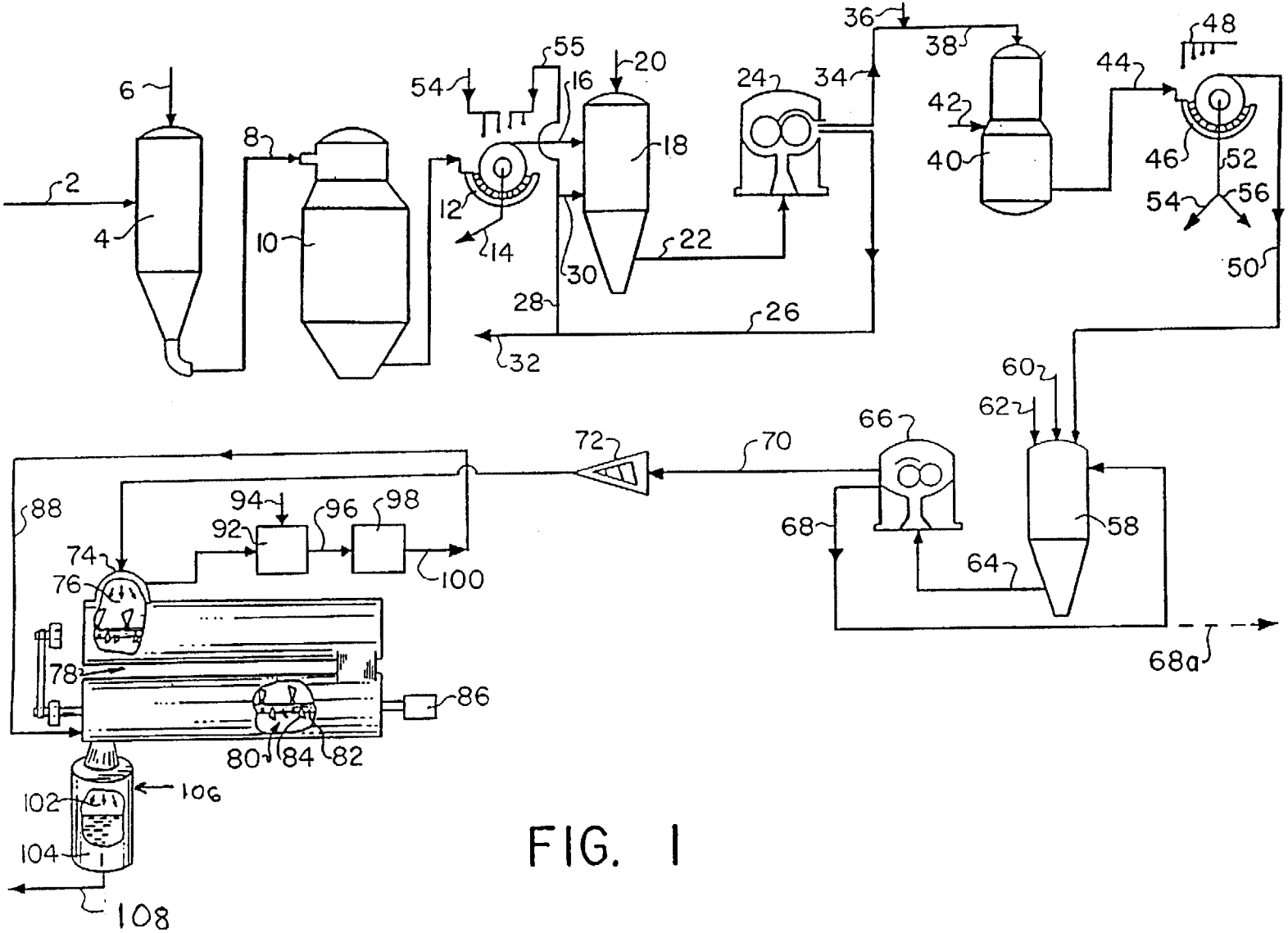
FIG. 1 schematically illustrates the pulping, oxygen delignification and ozone delignification steps which represent the bulk delignification portion of the process of the invention.

In this application, the term "sparingly soluble" will be used to describe ions or salts which have limited solubility in water or other aqueous bleach plant process streams or which are insoluble in such solutions. The most common examples of such ions include calcium and barium. These and other ions are generally present in all pulp manufacturing processes as naturally occurring elements that enter the process primarily with the wood. These ions typically form salts that have limited solubility or are sparingly soluble and can precipitate in the process when changes occur in concentration, pH or temperature of streams which contain such salts. This is especially true in a closed system where most or all process streams are recycled to minimize water usage and the environmental impact of the process, since the amounts of such salts in solution can increase or accumulate over time.

When precipitation of such salts occurs, the precipitate manifests itself as a scale or deposit on the metal surfaces of the process equipment, thus reducing the efficiency of or interfering with the proper operation of such equipment. As this scale accumulates, it causes it causes the equipment to become non-functional. This problem is of a greater concern in process equipment that contains screens or other relatively small apertures or openings which can be plugged by scale and require shutdown of the equipment for cleaning and scale removal. The present invention eliminates or minimizes this problem by avoiding pH shock due to wide pH variations of the streams to be combined. In addition, the pH of certain process streams are controlled so that such streams can solubilize calcium, barium or other scale producing salts therein rather than allow them to precipitate where not desired.

In a closed pulp bleaching process, calcium generally precipitates as a carbonate, oxalate or sulfate salt. Calcium oxalate precipitation will occur when an acid stream containing calcium and oxalate ions undergoes a pH change to the basic side. Calcium sulfate and calcium carbonate precipitation will generally occur when calcium and/or carbonate concentrations in the process stream exceed solubility limits. The precipitation of calcium oxalate produces a tenacious scale which is difficult to remove and which causes plugging of process equipment apertures. Calcium carbonate scale is less tenaciously adhered and thus, easier to remove.

In this invention, the formation of scale by, e.g., precipitation of such salts can be selectively controlled by washing acidic pulp streams with an aqueous wash solution having a pH which is not greater than the pH of the pulp stream and a salt concentration which is below saturation to remove at least some of said salts from the pulp stream to thereby reduce or eliminate the formation of salt scale upon process equipment during subsequent pulp treatment steps. The wash solution thus removes the salts or ions which could otherwise precipitate on process equipment to form scale, because their concentration is reduced below the precipitation point. The wash solution can be applied to the pulp in a tower, tank, or other relatively static vessel or in a mixer, washer or other dynamic washing device. Use of this solution effectively prevents such salts from depositing or accumulating on or in process equipment, even in a closed pulp bleaching plant where substantially all wash effluents and filtrates are countercurrently recycled.

According to the prior art, scaling problems are generally combatted using anti-scaling additives. One particular additive, known as Betz CSC 845 and which is available from Betz Paper Chem, Inc. has been added to a conventional $O_mZ_mE_oD$ process according to U.S. Pat. No. 5,164,043 in an attempt to reduce the occurrence of scaling at the washer between the ozone stage and the alkaline extraction stage. This additive did not resolve the scaling problem on the post ozone stage washer, which problem is due to pH shock from the difference in pH between the pulp exiting the ozone reactor and the water used to wash that pulp.

The present invention recognizes that a simple reduction in pH differential between that of the pulp and the wash water dramatically reduces scaling and eliminates the need for the addition of an anti-scaling additive. The control of the liquid in the dilution tank downstream of the ozone reactor to a pH of about 9 or greater allows the pulp to be washed with water that has a pH which is about the same or lower without producing scale. As noted above, it has been found that scaling occurs due to pH shock to a process stream, such as when the pH of the wash solution is substantially higher than the pH of the pulp.

When this advantage was discovered, it was initially believed that fresh caustic would have to be added to avoid introducing components which could consume brightening chemicals in the subsequent brightening stage. Further testing revealed that the use of the hot water extraction removed substantially all of such chemical consuming components from the pulp, so that oxidized white liquor or other recycled alkaline sources could be utilized. This represents a cost savings in such chemicals to about 90%.

Although the use of oxidized white liquor introduces slightly greater amounts of carbonate ions into the system, this presents a much less serious problem than the precipitation of calcium and barium oxylates, which produce much greater and more tenacious scaling problems.

Another concern is the type of equipment in which scaling occurs. In a tower or other relatively open apparatus, some scale can be tolerated as a buildup on the interior walls of the apparatus, since it does not interfere with its operation. In apparatus that contains screens or other relatively small apertures, even a small scale buildup can compromise operation. Such equipment includes washers, wash presses, filters and the like, and it is extremely important to prevent scale buildup in those devices so that the bleach plant can operate continuously until scheduled maintenance periods. The present invention reduces the occurrence of scale formation in such equipment to avoid unexpected shutdowns.

It was also unexpectedly discovered that anti-scaling additives did not have to be added to the process to prevent scaling, as the washing steps and hot water soak were sufficient to retain salts in solution and remove contaminants which would otherwise consume bleaching chemicals during final brightening steps. Thus, a significant cost savings is realized by not having to use such anti-scaling additives.

The multi-stage process of the invention also eliminates the use of elemental chlorine and/or chlorine-containing bleaching agents, thus substantially reducing or eliminating pollution of the environment while optimizing the physical properties of the resultant pulp product in an energy efficient, cost effective manner. The present process is operable on virtually all wood species, including the difficult-to-bleach southern U.S. softwoods, as well as the more readily bleached hardwoods.

The hot water extraction step of the present invention can be included in any bleaching process in place of an alkaline extraction stage. Generally, this hot water extraction stage would be used after bulk delignification to remove contaminants and other impurities from the pulp so that they will not consume brightening agent in a later brightening stage. The applicable pulp bleaching sequences can include several stages before the hot water extraction stage. For the most preferred embodiment, the sequence includes a pulping stage, an oxygen delignification stage and an ozone delignification/bleaching stage which together comprise the bulk delignification portion of the process. In addition, various brightening sequences can follow the hot water extraction stage without requiring intervening alkaline extraction stages. The resultant pulp has GE brightness values comparable to those in the prior art without sacrificing pulp strength, as well as reducing total chemical usage in the overall process.

The present bleaching processes reduce the amount of lignin as much as is practical in the bulk delignification portion of the process, as evidenced by a corresponding decrease in the K No. of the pulp, without a concomitant substantial and therefore unacceptable decrease in pulp strength. This, in turn, ensures that the viscosity of the pulp exiting the ozone delignification bleaching stage remains sufficiently high to permit the pulp to withstand the effects of the subsequent bleaching and brightening treatments, thus enabling the formation of a final pulp product having sufficient strength and GE brightness ("GEB") for its intended application.

Following the ozone delignification stage, the substantially delignified pulp has a GEB of from about 40–80 and preferably at least about 59. Generally, for softwoods, the target brightness after the ozone stage is about 48–70, while for hardwoods, it can be as high as 60–80. Subsequent brightening treatments are then used to raise the GE brightness value. Final brightnesses in the range of about 80 to 95 GEB are easily obtained utilizing any one of a variety of brightening agents. Typical brightening agents include chlorine dioxide or a peroxide compound, the latter being preferred when a totally chlorine free process is desired. Preferably, the peroxide treatment is preceded by a metal ion control stage, such as chelation ("Q"), with or without washing. Further details on the process steps for the most preferred embodiments follow.

A. Pulping

The first stage in the method of the present invention is the pulping step. Here, procedures may be utilized which improve the amount of lignin removed from the lignocellulosic material, while minimizing the amount of degradation of the cellulose.

A processing scheme for carrying out the "front end" of a bleaching sequence according to the present invention is illustrated in schematic form in FIG. 1. Wood chips 2 are introduced into a digester 4 together with a white liquor 6 comprising sodium hydroxide, sodium sulfide and, in the preferred embodiment, an anthraquinone additive. Sufficient white liquor should be introduced into digester 4 to substantially cover the wood chips. The contents of digester 4 are then heated at a temperature and for a time sufficient to allow the liquor to substantially impregnate the wood chips.

The use of the Kraft/AQ pulping technique is preferred since the inclusion of the anthraquinone additive contributes significantly to the degree of be lignin removal without causing significant adverse affects upon the desired strength characteristics of the remaining cellulose. The amount of anthraquinone in the cooking liquor should be at least about 0.01% by weight, based upon the oven dried ("OD") weight of the wood to be pulped, with amounts of from about 0.02 to 0.1% generally being preferred. Although the Kraft/AQ technique costs more to perform than, for example, an unmodified Kraft treatment, this additional cost is at least partially offset by the savings in the cost of chemicals needed for the subsequent oxygen, ozone and brightening stages and the increased yield in the resulting pulps.

Alternately, or perhaps even in addition to the use of the Kraft/AQ process, the pulping stage can be carried out with the use of techniques for extended delignification such as the Kamyr MCC and EMCC or isothermal cooking, Beloit RDH and Sunds Cold Blow methods. These techniques also offer the ability to remove more of the lignin during cooking without adversely affecting the desired strength characteristics of the remaining cellulose to a significant degree.

Still further, the pulping stage may be carried out, if desired, with the use of an unmodified Kraft process. The Kraft process is not particularly practical for use in the present invention unless it is coupled with an oxygen treatment which is sufficient to remove correspondingly more lignin in the oxygen delignification step without adversely affecting the strength of the oxygen delignified pulp. This combination is capable of producing a pulp of sufficient brightness and viscosity to permit effective ozone delignification and subsequent brightening to the high GEB values stated above. In contrast, the combination of Kraft pulping plus "standard" oxygen delignification (described below) produces a pulp which may not retain sufficient viscosity, i.e., strength, to form a useful product after completion of the remaining delignification and brightening steps.

The pulping step is conducted so that, for a southern U.S. softwood, for example, conventional Kraft pulp with a K No. in the range of about 20–24 (target of 21), a CED viscosity in the range of about 21–28, and a GE brightness in the range of about 15–25 is typically obtained. For southern U.S. hardwood, conventional Kraft pulp with a K No. in the range of about 10–14 (target 12.5) and a CED viscosity of about 21–28 is typically obtained.

FIG. 1 illustrates a digester 4 which produces a black liquor containing the reaction products of lignin solubilization together with brownstock pulp 8. The cooking step is typically followed by washing to remove most of the dissolved organics and cooking chemicals for recycle and recovery, as well as a screening stage (not shown) in which the pulp is passed through a screening apparatus to remove bundles of fibers that have not been separated in pulping. The brownstock 8 is treated in washing units comprising, in sequence, a blow tank 10 and washing unit 12 where residual liquor 14 contained in the pulp is removed.

B. Oxygen Delignification

The next stage in the preferred process of the present invention is an oxygen delignification step, which primarily involves removal of residual lignin from the brownstock pulp. In accordance with conventional high consistency oxygen delignification techniques (i.e., "O"), the washed pulp is pressed to a high consistency of at least about 25% and an aqueous alkaline solution is then sprayed onto the resultant fiber mat to deposit from about 0.8–7% by weight of the alkaline material onto the pulp. The high consistency alkaline fiber mat is then subjected to oxygen delignification to remove a substantial portion of the lignin from the pulp. When used to obtain substantial decreases in K No., i.e., greater than 50%, this procedure is known to cause substantial decreases in pulp viscosity, which leads to a strength deficit in the final product. Thus, it is important to couple this technique with one of the more efficient pulping processes, such as Kraft/AQ and/or extended delignification, in order to obtain pulp with sufficiently low K Nos. for use in the remainder of the present bleaching process.

It has been found that the oxygen delignification treatment may be modified and conducted in a manner which allows for the removal of increased percentages of the lignin remaining in the brownstock pulp without causing an unacceptable corresponding decrease in the viscosity of the pulp. This allows conventional Kraft pulping to be used with such modified oxygen delignification techniques while still obtaining the desired K Nos. and viscosities.

In one process, designated herein as $O_m$ (m=modified), the brownstock pulp is treated at low to medium consistency with an amount of alkali necessary to ensure uniform application thereof upon the pulp. The brownstock is maintained at a pulp consistency of less than about 10% and preferably less than about 5% by weight. The consistency of the pulp is generally greater than about 0.5%, however, since lesser consistencies are not economical to process in this manner. A most preferred consistency range is 0.5 to 4.5%. Thereafter the consistency of the pulp is raised to at least 18 percent. Preferably the pulp consistency is raised from about 20% to about 35%, and even more preferably, to about 27%. Thereafter the high consistency pulp is directed to an oxygen reactor for delignification using conventional conditions.

The advantage of using the $O_m$ process is illustrated by comparison of the K Nos. and viscosities obtained using southern softwoods to those obtained with the O process under otherwise substantially identical process conditions. Using a conventional Kraft pulping procedure and conventional high consistency oxygen delignification bleaching, the pulp thus obtained will typically have a K No. of about 12 to 14 and a viscosity of about 15. This K No. is too large to permit later delignification using the ozone stage of the present invention. However, the use of conventional Kraft pulping with the modified high consistency oxygen bleaching surprisingly results in a pulp having a K No. of less than about 9, while the viscosity of the pulp is maintained above about 12 to 14.

These two values, i.e., K No. and viscosity, are related in that the ratio of the change in viscosity to the change in K No., referred to as the "delignification selectivity" of the process, is a measure of the efficiency of the $O_m$ technique for removing lignin while maintaining adequate levels of viscosity therein. The use of the $O_m$ process, as described above, thus results in an enhanced degree in the selectivity of the delignification, signified by a reduction in K No. of at least about 20% greater than that obtained with the use of an "O" stage. Thus, the combination of Kraft pulping and $O_m$ oxygen delignification will result in an enhanced delignification selectivity, i.e., a sufficiently low K No. and a sufficiently high viscosity, to permit further delignification and bleaching by ozone and peroxide.

Further details of the $O_m$ oxygen delignification process are disclosed in U.S. Pat. No. 5,217,574, the disclosure of which is expressly incorporated herein by reference thereto.

Alternately the oxygen delignification treatment may be carried out using a two-stage "$O_s$" (s=split) alkali addition. In this stage a first amount of alkaline material is applied to pulp at low consistency by combining the pulp with a quantity of alkaline material in an aqueous alkaline solution. The consistency of the pulp is then increased to a high consistency of at least about 18%. Next, a second amount of alkaline material is applied to the high consistency pulp to obtain a total amount of alkaline material applied to the pulp. After this treatment, the pulp is then subjected to oxygen delignification whereby the enhanced delignification selectivities of the $O_m$ process are achieved.

While the $O_m$ process is preferred over the standard "O" method, the alternate $O_s$ technique is most preferred because a lower proportion of the alkaline material (i.e., than with the $O_m$ process) is applied to the low consistency pulp. This, in turn, reduces the amount of alkaline material utilized in mixing chest 18 and also reduces the amount of this material removed via pressate discharge 32 (see below). Thus, splitting the application of the alkaline material between the high and low consistency pulp reduces the amount of pressate discharge 32 which, in turn, reduces the amount of alkaline material which must be reintroduced, thus saving chemical. Further the high consistency alkaline treatment portion of the $O_s$ method permits rapid modification of the amount of the alkaline material present in the pulp entering the oxygen delignification reactor to compensate for changes in the properties (i.e., wood type, Kappa or K. No. and viscosity) of the incoming brownstock, or to vary the degree or extent of oxygen delignification for a particular pulp.

Referring again to FIG. 1, washed brownstock 16 is introduced into a mixing chest 18 where it is substantially uniformly treated with sufficient alkaline material 20 for a time sufficient to distribute a first amount of alkaline material throughout the pulp. The low consistency treatment portion of this $O_s$ process is carried out in the same manner as the $O_m$ process, but less alkaline material (i.e., about half as much) is applied to the pulp. In the $O_m$ process, an aqueous sodium hydroxide solution is combined with the low consistency pulp in an amount sufficient to provide essentially the same amounts on the OD pulp as was achieved by the O process. In the $O_s$ process, at least about 0.4% to about 3.5% by weight of sodium hydroxide is deposited on the pulp, based on oven dry ("OD") pulp after thickening with the balance applied to the high consistency pulp. Other alkali sources having equivalent sodium hydroxide content can also be employed instead of sodium hydroxide if desired. Oxidized white liquor is a convenient plant stream which may be utilized.

The alkaline treated pulp 22 is forwarded to a thickening unit 24 such as a twin roll press where the consistency of the pulp is increased to the desired value. The pulp consistency increasing step also removes residual liquid or pressate 26. A portion 28 of this pressate 26, may be directly recycled back to brownstock washer 12. Alternately, a portion 30 may instead be directed to mixing chest 18 for use in the low consistency pulp alkaline treatment step. Since the consistency of the pulp is increased in the thickening unit 24, a certain amount 32 of pressate may continually be discharged to the plant liquid recovery system to maintain water balance in the mixing chest 18.

Additional alkaline material 36 is applied to the high consistency brownstock 34 produced by the thickening unit 24 to obtain the desired total amount of alkaline material on the pulp prior to oxygen delignification. This total amount of alkaline material is selected to achieve the desired extent of delignification in the subsequent oxygen delignification step which is carried out on the alkaline material treated high consistency pulp. The total amount of alkaline material actually applied onto the pulp will generally be between 0.8 and 7% by weight based on oven dry pulp, and preferably between about 1.5 and 4% for southern softwood and between about 1 and 3.8% for hardwood. About half these amounts are preferably applied in each of the low consistency and high consistency treatments. Thus, about 0.4 to 3.5% by weight, preferably about 0.5 to 1.9% for hardwood and 0.75 to 2% for softwood, is applied onto the pulp during each of the low and high consistency alkaline treatments.

Further details concerning the "$O_s$" process are set forth in U.S. Pat. No. 5,173,153, the disclosure of which is expressly incorporated herein by reference thereto.

The alkaline treated pulp 38 is then forwarded to the oxygen delignification reactor 40 where it is contacted with gaseous oxygen 42. Suitable conditions for oxygen delignification according to either the O, $O_m$ or $O_s$ processes comprise introducing gaseous oxygen at about 80 to about 100 psig to the high consistency pulp while maintaining the temperature of the pulp between about 90° and 130° C. The average contact time between the high consistency pulp and the gaseous oxygen ranges from about 15 minutes to about 60 minutes.

After oxygen delignification in reactor 40, the partially delignified pulp 44 is forwarded to washing unit 46 wherein the pulp is washed with water 48 to remove any dissolved organics and to produce high quality, low color pulp 50. A first portion 54 of the oxygen stage washer 46 filtrate 52 can be used to advantage in a first shower on the brownstock washer 12. This improves washing and reduces the pressate portion 55 which is used in a second shower on washing unit 12 and later returns into the residual liquor 14 which is sent to the plant recovery without further reuse. A second portion 56 of filtrate 52 is discharged directly to the plant recovery system.

Upon completing the oxygen delignification stage, the delignification selectivity of the pulp is enhanced in that the K No. of the pulp is decreased by at least about 50%, compared to the decrease of no more than about 50% with conventional oxygen delignification systems, without significantly damaging the cellulose component of the pulp. The GE brightness of the pulp after this stage is generally between about 30 and 50 depending upon the type of pulp and the specific pulping conditions utilized. For the softwood pulp described above, a K No. of about 7–11 and a viscosity of above about 13 is readily achieved. For hardwood pulp, a K No. of about 5–8 and a viscosity above about 13 is obtained after the oxygen delignification step.

C. Ozone Delignification

The next step in the process of the invention is ozone delignification of the oxygen-delignified brownstock pulp. Treating pulp at high consistencies with ozone without paying particular attention to the comminution of the pulp fibers or to the contact between the individual fibers and the reactant gas stream invariably results in a non-uniform ozone bleaching of the fibers. Such a non-uniform ozone treatment is designated in the prior art with the letter "Z". While the use of a Z stage is not desirable due to the non-uniformities produced, there are situations where the resulting pulp is useful. However, it is preferred to use a modified ozone technique in which the fibers in a desired size range are uniformly contacted with the ozone gas stream. This ozone treatment has been designated herein as "$Z_m$".

Prior to treatment with ozone, the pulp is conditioned so as to ensure the most effective selective delignification and to minimize the chemical attack of the ozone on the cellulose. As illustrated in FIG. 1, the incoming pulp 50 is directed into a mixing chest 58, where it is diluted to a low consistency. An organic or inorganic acid 60 such as sulfuric acid, formic acid, acetic acid or the like, is added to the low consistency pulp to decrease the pH of the pulp in mixing chest 58 to the range of about 1 to 4 and preferably between 2 and 3.

The acidified pulp is treated with chelating agent 62 to complex any metals or metal salts which may be present therein. This chelating step is used to render such metals non-reactive or harmless in the ozone reactor so that they will not cause breakdown of the ozone, thus decreasing the efficiency of the lignin removal and also reducing the viscosity of the cellulose. Preferred chelating agents for this ozone treatment, for reasons of cost and efficiency, include diethylenetriamine pentacetic acid ("DTPA"), ethylenediamine tetraacetic acid ("EDTA") and oxalic acid. Amounts of these chelating agents ranging from about 0.1% to about 0.2% by weight of OD pulp are generally effective, although additional amounts may be needed when high metal ion concentrations are present.

The acidified, chelated, low-consistency pulp 64 is introduced into a thickening unit 66, such as a twin roll press, for removing excess liquid 68 from the pulp, wherein the consistency of the pulp is raised to a level above about 20%. At least a portion of this excess liquid 68 may be recycled to mixing chest 58 with a remaining portion **68*a* being directed to the plant recovery. The resultant high consistency pulp 70 is then passed through compaction device 72 such as a screw feeder which acts as a gas seal for the ozone gas and thereafter through a comminuting unit 74**, such as a fluffer, for use in reducing the pulp particle size as described below.

A preferred range of consistency, especially for southern U.S. softwood, has been found to be between about 28% and 50%, with the optimum results being obtained at between about 38% and 45% prior to contact with ozone. Within the above ranges, preferred results are obtained as indicated by the relative amount of delignification, the relatively low amount of degradation of the cellulose, and the noticeable increase in the brightness of the treated pulps.

The reaction temperature at which the ozone bleaching is conducted is likewise an important factor. The maximum temperature of the pulp at which the reaction should be conducted should not exceed the temperature at which excessive degradation of the cellulose occurs, which with southern U.S. softwood is a maximum of about 120° F. to 150° F.

An important feature of the ozone stage of the invention is that the pulp be uniformly bleached by the ozone. This uniform bleaching is obtained, in part, by comminution of the pulp into discrete floc particles of a size which is of a sufficiently small diameter and of a sufficiently low bulk density so that the ozone gas mixture will completely penetrate a majority of the fiber flocs. Generally, a comminuted pulp particle size of 10 mm or less has been found to be acceptable.

During the ozone bleaching process, the particles to be bleached should be exposed to the gaseous ozone bleaching agent by mixing so as to allow access of the ozone gas mixture to all surfaces of the flocs and equal access by the ozone gas mixture to all flocs. The mixing of the pulp in the ozone gas mixture gives superior results with regard to uniformity as compared to the results obtained with a static bed of flocs which results in channeling wherein some of the flocs are isolated from the ozone gas relative to other flocs and are thereby bleached less than other flocs.

Upon exiting fluffer 74, the oxygen delignified pulp particles 76 enter a reactor apparatus 78 adapted for bleaching these particles from a first GE brightness to a second, higher GE brightness. The pulp fiber particles 76 are bleached by the ozone in reactor 78 typically to remove a substantial portion, but not all, of the lignin therefrom. A preferred apparatus comprises a paddle reactor as described in U.S. Pat. No. 5,181,989 and U.S. Pat. No. 5,472,572, the disclosure of each of which is expressly incorporated herein by reference thereto.

As the pulp particles are advanced through this reactor, an internal conveyor 80, preferably in the form of a rotating shaft 82 to which is attached a plurality of paddle members 84, powered by motor 86, is used to provide intimate contact and mixing between the pulp particles and the ozone gas. These conveying means displace and toss the pulp particles in a radial and forward direction while also inducing the ozone to flow and surround the displaced and tossed pulp particles, to expose substantially all surfaces of a majority of these particles to the ozone. This facilitates substantially complete penetration of all surfaces of these particles by the ozone.

At low RPMs, the paddles move the pulp in a manner such that it appears to be "rolling" or "lifted and dropped"

through the reactor. At higher RPMs, the pulp is dispersed into the gas phase in the reactor, with the pulp particles uniformly separated and distributed throughout the gas, causing uniform bleaching of the pulp. The overall bleaching rate of the pulp particles is thus significantly improved compared to prior art bleaching methods utilizing fast-reacting gaseous bleaching agents such as ozone.

The forward movement of the dispersed pulp approximates plug flow and facilitates a high degree of bleaching uniformity. The reactor is operated at a dispersion index of less than 7, preferably less than about 4.8, at all rotational speeds of less than about 125 rpm and is designed to simultaneously control pulp contacting, pulp residence time and gas residence time while effectively consuming up to 99 percent of the ozone. In this way the pulp is bleached to the desired degree while a significantly high conversion of ozone gas bleaching agent is achieved.

The ozone gas which is used in the bleaching process may be employed as a mixture of ozone with oxygen and/or an inert gas, or it can be employed as a mixture of ozone with air. The amount of ozone which can satisfactorily be incorporated into the treatment gases is limited by the stability of the ozone in the gas mixture. Conventional ozone gas mixtures which now typically contain about 1–14% by weight of ozone in an ozone/oxygen mixture, or about 1–7% ozone in an ozone/air mixture, are suitable for use in this invention. The ozone gas can be introduced at any position through the outer wall of the shell of the reactor.

As shown in FIG. 1, ozone gas 88 is introduced into the reactor 78 in a manner such that it flows, in one embodiment of the invention, countercurrent to the flow of the pulp.

Any residual ozone gas 90, as it exits reactor 78, is directed to a carrier gas pretreatment stage 92 where a carrier gas 94 of oxygen or air is added. This mixture 96 is directed to ozone generator 98 where the appropriate amount of ozone is generated to obtain the desired concentration. The proper ozone/air or ozone/oxygen mixture 100 is then directed to reactor vessel 78 for delignification and bleaching of pulp particles 76. A further description and discussion of the reaction conditions utilized in the ozone delignification stage of the invention can be found in U.S. Pat. No. 5,164,043, the disclosure of which is expressly incorporated herein by reference thereto.

Another type of ozone stage which would be suitable for use in the present invention utilizes a high shear mixing device to combine the ozone with low or medium consistency pulp. The particular consistency of the pulp can be between about 1 and 15% with between about 1–5% used for low consistency and between about 6 and 15% used for medium consistency, with one of ordinary skill in the art being capable of selecting the particular consistency for the desired final pulp. Ozone gas mixed with water can also be added to the mixing device. The concentration of the ozone gas in the high shear mixer is adjusted so that the amounts described above are applied to the pulp. A preferred high shear MC mixer is disclosed in U.S. Pat. No. 5,145,557, the content of which is expressly incorporated herein by reference thereto. The ozone and pulp are substantially uniformly combined in this device so that the ozone has access to all pulp particles for reaction therewith. Since the ozone-pulp reaction is very rapid, the pulp contact with ozone gas in the mixer is sufficient to delignify and brighten the pulp to the desired values.

D. Alkaline Solution Quench

Pulp fiber flocs 102, after ozone treatment, are directed into a dilution tank 104 by spray from water nozzles which create a water shower that soaks the pulp and quenches the ozone bleaching reaction on the pulp particles. It is desirable that the quenching occur as uniformly and as quickly as possible in order to preserve the bleaching uniformity achieved in the reactor apparatus. Thus, these nozzles are arranged to provide an even, soaking shower of water while also being angled downward at an angle of at least 30° with respect to the horizontal and preferably at about 45°, in order to force the pulp down into the tank and avoid the formation of a water curtain which would inhibit the free fall of the pulp. The pulp collected in tank 104 has a consistency of about 6% and is washed and recovered or transported to subsequent extraction and brightening treatments.

As the pulp exiting the reactor is acidic, i.e., having a pH of between about 1 and 4, the liquid in the dilution tank would rapidly become acidic if not treated. Caustic material 106 is added in an amount sufficient to raise the pH of the solution in the tank 104 from its untreated value (about 1 to 4 and typically about 3 to 4 for the preferred $Z_m$ embodiment) to at least about 7 or greater, since the other sources of fluid in the tank, i.e., the water sprays, generally have a pH value of about 7 or more. It is to be understood that the term "caustic material" is used broadly in this invention to include any suitable source of alkaline material, and preferably one which contains sodium hydroxide. In a pulping and bleaching plant, there are numerous sources of caustic material, including oxidized white liquor, make-up sodium hydroxide and the like, and any or all of these sources or combinations thereof are suitable for use as caustic material in this invention. Other alkaline streams that can be used as a source of caustic material would include extraction stage filtrate, oxygen stage filtrate and the like. Of course, any plant stream which has an alkaline pH and is available in a sufficient quantity to neutralize the acidic effluent can be used. One of ordinary skill in the art can easily calculate the appropriate amount of caustic material to be added based on the concentration of the material that is used, the relative amounts of water and added caustic and other generally known chemical engineering considerations. If desired, caustic material can be added as a solution which is used as the soaking shower that is sprayed upon the pulp exiting the reactor 78. In effect, the addition of such caustic material to the dilution tank creates an extraction stage which immediately follows the ozone reaction without an intermediate washing step.

As noted above, the solution in tank 104 is provided with a pH of at least about 7 and preferably about 8 to 12. Typically, one of ordinary skill in the art would contemplate the use of fresh sodium hydroxide as the source of caustic material for raising the pH of the solution in this tank 104, because this material would be relatively clean and free of impurities which when introduced on the pulp could consume brightening chemical in the subsequent brightening stage. The cleanliness of the alkaline material is of lesser concern in this invention, however, since it has been found that the subsequent hot water extraction would remove impurities such as, e.g., thiosulfates which would consume $ClO_2$ or peroxide compounds in subsequent brightening stages. Thus, it is preferred to utilize oxidized white liquor, a plentiful, less expensive, recycled alkaline source, at a considerable cost savings, to control or maintain the pH of the solution in this tank at the desired alkaline level. Also, the term $Z_e$ is used to refer to the combination of the high consistency, turbulently mixed ozone delignification stage followed by the addition of the alkaline solution 106 in tank 104 to treat the pulp exiting the ozone delignification stage.

The treatment of the ozone delignified pulp in the alkaline dilution tank is, in effect, somewhat similar to an alkaline extraction stage. As with any extraction stage, the addition of alkaline material decreases the amount of oxidant required in the subsequent bleaching sequence, and the cost of alkaline material is less than the reduced amount of subsequent brightening agents. The pulp residence time in the solution in this tank 104 is about 5 minutes, although depending upon specific operation of the process, this time period can vary from less than about 1 to 30 minutes.

Pulp 108 exiting the ozone reactor and dilution tank 104 has a GE brightness of at least about 48 percent and generally around 50 to 80 percent as noted above, with hardwoods usually being above about 60 percent. The pulp (for hardwoods or softwoods) also has a K No. of between about 3 and 6.

For certain papermaking processes, a final pulp brightness in the upper end of this range is satisfactory. When it is necessary to further raise the pulp brightness to higher GEB values, the substantially delignified pulp from the $Z_e$ stage is subsequently subjected to a brightening sequence, which is primarily intended to remove most or all of the remaining lignin and convert any remaining chromophoric groups on the lignin in the pulp into colorless derivatives. Often, the pulp 106 exiting the dilution tank 104 is already of sufficient minimum initial GE brightness (i.e., at least about 59) for certain uses so that further brightening is not necessary. The present invention contemplates the production of pulp having a brightness of about 80 to 95 or greater GEB, however, so that the ozone delignified pulp 106 is then subjected to a hot water extraction stage followed by a brightening stage.

Regarding pulp brightness, the term "bleaching efficiency" is used to mean the gain in bleaching due to increased brightness or increased delignification per amount of bleaching or delignifying agent consumed or applied, respectively.

E. Hot Water Extraction Stage

Figure 2:
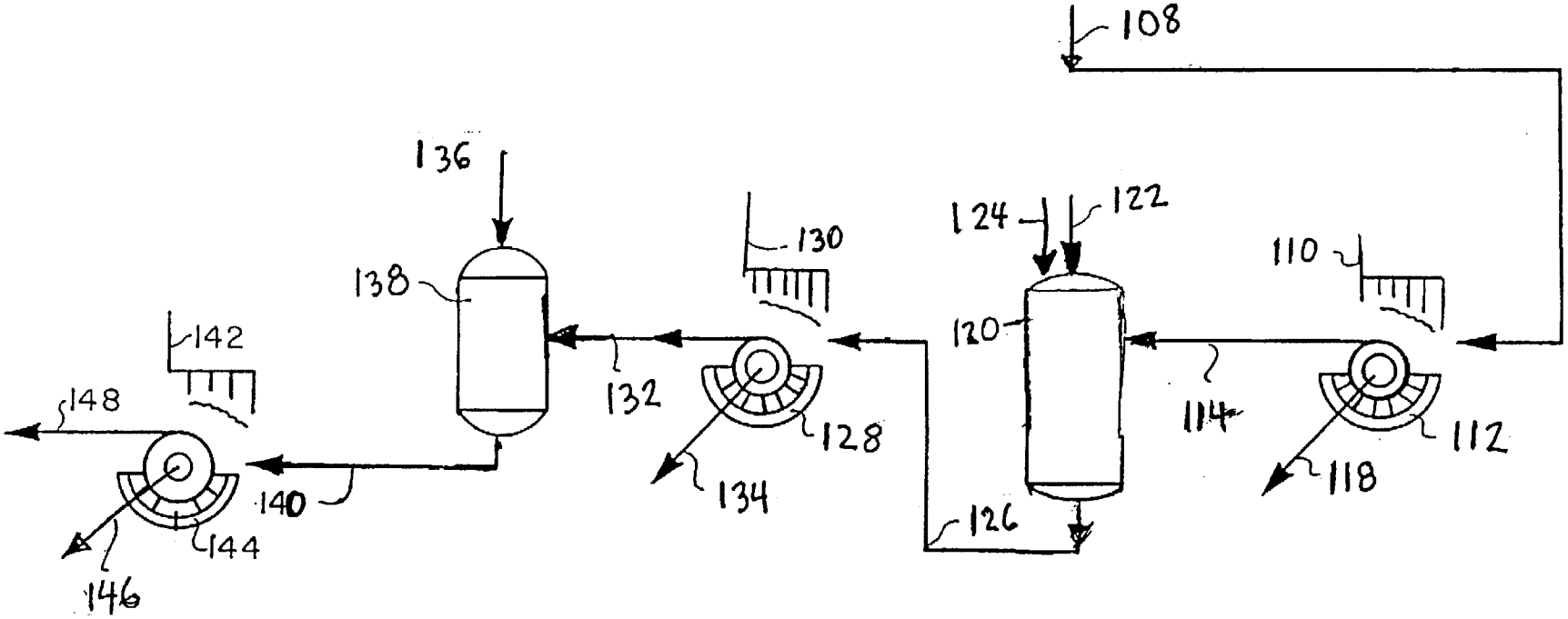
FIG. 2 schematically illustrates a hot water extraction step which may be used in the process of the present invention in conjunction with chlorine dioxide brightening step to produce a final pulp having the desired brightness.

After completion of-the ozone delignification and alkaline solution quench steps, the substantially delignified pulp 108 is thoroughly washed with plant water 110 in washer 112 as shown in FIG. 2. The plant water typically has a pH of between about 7 and 8. The washed pulp 114 has a pH near or slightly above neutral and a consistency of about 16%. Since chlorine containing compounds have not been used to delignify the pulp, it is possible and often desirable to recycle at least a portion of the effluent 118 which is recovered from washing unit 112 to washing unit 46 as at least a portion of stream 48, as this produces environmental benefits due to the elimination of what would otherwise be sewered liquid.

Washed pulp 114 is then directed into a tower 120 where a hot water extraction is carried out to remove pulp contaminants and to condition the pulp. This extraction is carried out by contacting the washed pulp 114 with process water 122 having a pH of typically between 6 and 8. Plant steam 124 is utilized to heat the pulp, extraction water or water/pulp mixture to preferably between about 160° and 170° F. The water/pulp mixture is then retained in the tower 120 for a sufficient time to extract pulp contaminants that would react with the brightening agents in the subsequent brightening stage. It is believed that these contaminants are removed primarily by diffusion from the pulp fiber into the water, a time of between about 60 to 90 minutes is generally sufficient at that temperature range. The extraction time depends upon the water temperature, so that at higher temperatures, shorter contact times can be used. A contact time of between about 1 and 360 and preferably about 5–120 minutes can be used with temperatures of between about 200° and 100° F., with the shorter times corresponding to the higher temperatures. Alternatively, a hot water washer or wash press can be used instead of the preferred extraction tower mentioned above.

This hot water extraction is also advantageous in that it removes the undesirable components while it does not affect the strength of the pulp. Since the undesirable components diffuse from the pulp in this stage, the pH does not have to be high, and neutral conditions are acceptable. This avoids the need to apply additional alkaline material directly to the pulp for a prolonged period, such as would be done in an alkaline extraction,with essentially no pulp damage and thus greater strength as a result.

The pH of the aqueous wash solution will generally differ from that of the pulp stream by no more than about 2 units. Although a difference of about 4 to 5 units is still effective, it is not economic for the mill to run this way. Where economic considerations are of no concern, it is entirely suitable to operate at larger pH differences.

The control of the pH differences of these streams avoids pH shock, which is a change of at least 6 pH units. These relatively large pH changes cause sparingly soluble ions to drop out of solution. Many of these ions form scale which tenaciously adheres to the metal surfaces of processing equipment. If such scale forms on equipment that has small openings, such as washer screens, plugging can result, reducing the proper operation of the equipment and causing the plant to be shut down to remove the scale and remedy the problem. By avoiding pH shock, the mill operator can choose where precipitation of such salts can occur to thus avoid affecting the overall production and throughput of the pulp in the plant.

The extracted pulp 126 which exits extraction tower 120 is thoroughly washed in a washer 128 using fresh water 130. In addition, clean recycle plant water can be used instead of fresh water if the plant water does not introduce contaminants onto the pulp which would consume brightening agent in the subsequent brightening stage. The washed pulp 132 has a pH near neutral and a consistency of about 16%. The wash water effluent 134 from this washer 128 can be used to advantage as the washing water 110 for washer 112.

F. Preferred Brightening Sequences

At this stage of the process, several different brightening treatments may be selected with the particular one chosen depending on the type of wood pulp, the brightness of the pulp after the ozone stage and the desired GEB desired for the final product. It is possible to utilize either chlorine dioxide or a peroxide compound as the brightening agent. Conventional chlorine dioxide treatments using chemicals that contain a relatively low amount of chlorine, e.g., the R8 process, are suitable for producing brightened pulp while allowing the compliance with water discharge requirements. When a fully chlorine-free process is desired, however, a peroxide compound is conveniently utilized for the brightening stage.

1. Chlorine Dioxide Stage

One useful brightening agent is chlorine dioxide. Since the pulps entering this stage are relatively low in lignin content, the brightening treatment can be conducted using between about 0.25 to 2% chlorine dioxide based on the oven dry weight of the pulp. Also, the consistency of the pulp in this stage is typically about 8 to 16%.

The pulp 132 which exits washer 128 has a pH near neutral and a consistency of about 16%. This pulp is combined with the chlorine dioxide brightening agent 136 in a conventional manner and for a conventional time period in vessel 138. After the brightening step, the pulp 140 is thoroughly washed in a washer 144 to a final pulp product 148 having a pH near neutral and a consistency of about 16%. The wash water 142 for this washer 144 would generally be fresh water, since this is the cleanest pulp in the process. The wash water effluent 146 from this washer 144 contains chlorides so that it would generally be sewered. Alternatively, this effluent 146 can be treated to remove chlorides and then recycled to other areas of the plant.

2. Peroxide Stage

Figure 3:
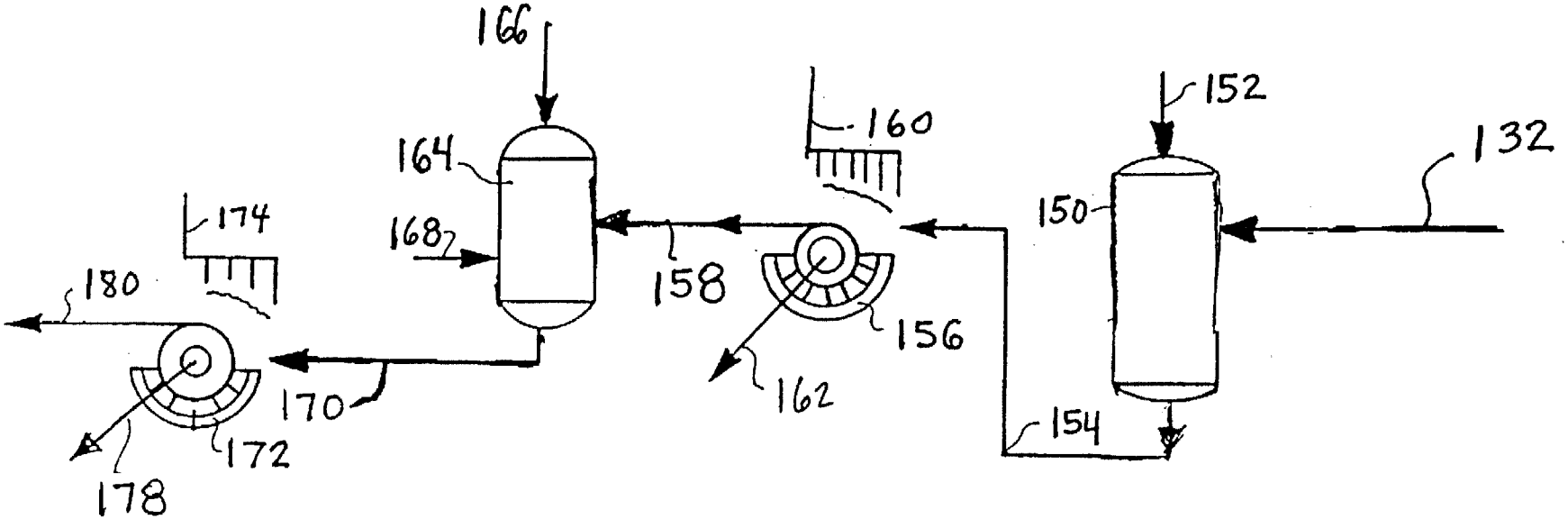
FIG. 3 schematically illustrates a hot water extraction step which may be used in the process of the present invention in conjunction with a peroxide brightening step to produce a final pulp having the desired brightness.

FIG. 3 illustrates the pulp treatment when a peroxide brightening stage, rather than a chlorine dioxide brightening stage, is to be conducted. As mentioned above, a peroxide compound, such as hydrogen peroxide, used at atmospheric conditions or under pressure and optionally including an oxygen or air atmosphere at elevated temperatures can be used. Any conventional peroxide bleaching treatment would be appropriate, and one of ordinary skill in the art would be aware of the necessary conditions for carrying out this step.

Pulp 132 which was washed in washer 128 after exiting hot water extraction stage 120 shown in FIG. 2, is first conditioned in a tank 150, where a chelant (such as EDTA or DTPA) 152 is added with water to sequester undesirable metal ions which could cause decomposition of the peroxide brightening agent. The consistency of the pulp is reduced to about 3–12% and the pH remains at about 5 to 8 while the pulp is held at about 90° C. for about 1 hour. The need for this treatment is dependent on the metal ion type, its amount in the pulp 132 and its accompanying dissolved solids. Under certain conditions, it may be possible to add the chelating components directly to the hot water extraction stage, thus avoiding the need for a separate conditioning stage.

The pulp 154 which exits tank 150 is thoroughly washed in a washer 156 to remove the chelants and any sequestered metal ions. The washed pulp 158 again has a pH near neutral and a consistency of about 16%. The wash water 160 for this washer 156 would generally be fresh water, and the wash water effluent 162 can be used to advantage as at least a portion of wash water 130 on washing unit 128.

The washed pulp 158 then is directed into a peroxide brightening tower 164, where a solution 166 of alkaline material and a peroxide compound, such as hydrogen peroxide, is added. This adjusts the consistency of the pulp to a range of between about 8–35%, while the pH of the pulp is adjusted upwardly to ensure a final pH of about 9.5 to 11. A peroxide stabilizing agent 168, selected from sodium silicate, magnesium sulfate, a chelating agent (such as EDTA or DTPA) or mixtures thereof, can be added in an amount sufficient to prevent the undesirable decomposition of the hydrogen peroxide bleaching agent. The stabilizing agents are added on a weight percent basis based upon the weight of the pulp, with preferred ranges of use being up to 3% of sodium silicate, up to 0.5% magnesium sulfate, i.e., as magnesium ($Mg^{++}$) and up to 0.5% of the chelating agent. When the effluent from washing the peroxide brightened pulp is to be recycled, the preferred stabilizing agent is magnesium sulfate.

The solution 166 to be added will generally include between about 0.25 and 4% by weight of a peroxide solution, preferably hydrogen peroxide, based upon the weight of the pulp. When hardwoods or other relatively easy to bleach woods are utilized, the peroxide treatment can be conducted by contacting the pulp with lesser amounts of the chemical within this range, while softwoods would generally require greater amounts of chemical which would typically be about 0.75 to 1%. The reaction is conducted in a brightening tower 164 for sufficient time to increase the brightness of the pulp to the desired levels. Generally, a GE brightness of about 67 to 88 and preferably above about 75–80 GEB is attained. The brightness value achieved will depend upon the amounts of chemical used and the brightness of the pulp as it enters into the peroxide brightening stage.

The specific peroxide compound to be used, which is generally hydrogen peroxide, as well as the particular stabilizer combinations are considered to be conventional and well within the knowledge of one skilled in the art.

The pulp 170 which exits tower 164 is again thoroughly washed in a washer 172 using fresh water 174. The washed pulp 180 again has a pH near neutral and a consistency of about 16%. The wash water effluent 178 from this washer 172 can be used to advantage as the washing water 160 for washer 156, since no chlorine containing chemicals were used in the brightening stage.

Since the hot water extraction stage does not apply alkaline material to the pulp, the final brightness may be slightly lower than when alkaline extraction stages are utilized. To achieve higher brightnesses, an additional amount of brightening agent can be applied. The use of a brightening agent in an amount which is increased by up to about 20% compared to the sequence that utilizes an alkaline extraction stage can be used to achieve substantially the same brightnesses with the added benefit that higher strengths are achieved with an overall chemical cost that is less.

3. Further Brightening

For certain woods, such as the difficult to bleach softwoods, it may be necessary to conduct a further brightening stage to achieve the final desired brightness of the pulp. Thus, a second brightening stage could be conducted using in the same manner as described above, except that significantly lower amounts of bleaching agent chemical would be needed. If desired, another hot water washing stage can be included between the initial and further brightening steps.

Other post treatments to stabilize the final brightness, such as $SO_2$ souring, may be employed. Such processes and materials are well known to those of ordinary skill in the art and need not be explained in any greater detail here.

The resultant pulp is fully bleached and brightened to GEB values typically of at least about 85 to as high as 93, thus rendering the final product suitable for use as a pulp for making high quality white paper.

EXAMPLES

The scope of the invention is further described in connection with the following examples which are set forth for purposes of illustration only and which are not to be construed as limiting the scope of the invention in any manner. Unless otherwise indicated, all chemical percentages are calculated on-the basis of the weight of oven dry ("OD") pulp. Also, one skilled in the art would understand that the target brightness values do not need to be precisely achieved, as GEB values of plus or minus 2% from the target are acceptable.

Example 1

A comparison of a bleaching sequence using the hot water extraction compared to an oxidative alkaline extraction was conducted in an operating bleach plant. The bleaching sequence for this plant included the steps of pulping, partial delignification with oxygen, further delignification with ozone, alkaline washing, oxidative alkaline extraction, and brightening with chlorine dioxide as generally disclosed in U.S. Pat. No. 5,164,043. The extraction ("E") stage is conducted as described in the aforementioned patent, i.e., by mixing the pulp with an alkaline material to solubilize a substantial portion of the lignin which remains in the pulp. The E stage for this example was augmented with oxygen ("$E_o$").

For the purposes of the comparison, the plant was run for 5 days under the conventional conditions described in the preceding paragraphs to process an average of 584 tons of pulp per day. Thereafter, the alkaline and oxygen addition to the extraction stage were omitted, the water was heated about 20° F. higher utilizing steam, and the plant was then run for 5 additional days to process an average of 593 tons per day. The chemical charge and performance data appear in Table 1.

TABLE 1

A. Process Performance

| | O-Stage | | Z-Stage | | | E- | D-Stage | | |
|---|---|---|---|---|---|---|---|---|---|
| Process | K No. | Visc mPa · s | GEB % | Visc. mPa · s | $O_3$ ppt | Stage GEB % | $ClO_2$ ppt | GEB % | Visc. mPa · s |
| Prior Art | 9.4 | 14.5 | 50.8 | 10.7 | 15.5 | 54.7 | 25.8 | 84.3 | 9.4 |
| Present Process | 9.5 | 13.8 | 52.5 | 10.2 | 13.5 | 54.8 | 29.2 | 85.1 | 9.3 |

B. Chemical Consumption

| | Amount (ppt) | |
|---|---|---|
| | Prior Art | Present Invention |
| Z-Stage | | |
| NaOH | 32.10 | 25.91 |
| $O_3$ | 15.54 | 13.50 |
| $H_2O_4$ | 66.52 | 56.44 |
| Extraction or Wash Stage | | |
| NaOH | 12.91 | 0 |
| $O_2$ | 7.59 | 2.56[1] |
| Increased Steam (estimated) | 0 | 103 |
| D-Stage | | |
| NaOH | 27.32 | 24.68 |
| $ClO_2$ | 25.77 | 29.24 |
| NaOH (buffer | 4.76 | 3.97 |

[1]Although the valve was shut, a 2.56 lb/ton flow was recorded and this amount was included in the calculations.

The average K Number of pulp entering the ozone stage in each test was about the same (a K Number of 9.4), while the average oxygen stage viscosity was lower for the test of the present invention (13.8 mPa.s vs 14.5 mPa.s). A smaller ozone charge was selected for the process of the present invention (13.5 ppt vs 15.5 ppt), which caused, in part, a slightly higher $ClO_2$ charge to be used (29.2 ppt vs 25.8 ppt). The final pulp brightness was higher for the present invention (85.1% GEB vs 84.3% GEB). At least about 3–4 pounds per ton of chlorine dioxide would be required by the conventional process to achieve the brightness of the pulp of the present invention. The ozone stage brightness was higher for the present invention even though with less ozone applied the K Number was expected to be higher (with a correspondingly lower GEB). The E-stage brightness values for each process were about the same before final brightening.

A cost savings in chemicals used amounting to approximately 15% was found, which for the production of 575 TPD for 300 days would amount to about $650,000. This saving is made without loss of brightness and while achieving a stronger pulp, as evidenced by the lesser drop in viscosity after the ozone stage, while reaching a higher brightness. The drop in viscosity between the ozone stage pulp and the fully bleached pulp was less for the present invention. The improvement was 0.4 mPa.s and this is considered significant, since a 0.5 change represents an increase in tear factor of about 10%.

In addition to the benefits in increased pulp strength and lower chemical costs, the present process also reduces or eliminates scale formation in process equipment. The lower pH of the hot water washing step produces lower pH filtrate after the pulp is washed. The solubility of ions such as calcium and barium in this filtrate is much higher because of the lower pH and higher temperature of that filtrate compared to the filtrate of pulp washed after alkaline extraction.

Example 2

In a conventional process which is essentially the same as that of Example 1, another comparison test was conducted. In this example, the only changes made to the conventional process were that the NaOH and oxygen which were added to the $E_o$ stage were discontinued, while the temperature of the solution in the $E_o$ tower was increased by 20° F. from 145° F. to 165° F.

The performance of the process was monitored for the two week period before the test and the two weeks of the test. In Table 2, this data is compared against the previous three month's performance as follows.

TABLE 2

| | $Z_o$-Stage | | E-Stage | D-Stage | | |
|---|---|---|---|---|---|---|
| Process | GEB (%) | Visc. mPa · s | GEB (%) | GEB (%) | Visc. mPa · s | $ClO_2$ ppt |
| Prior Art | | | | | | |
| 3 months | 52.2 | 10.6 | $E_o$ 58.2 | 84.7 | 9.5 | 25.4 |
| Invention | | | | | | |
| 2 weeks | 52.7 | 10.7 | Hot Water Wash 56.0 | 84.3 | 10.0 | 27.0 |

A reduction in the viscosity loss between the exit of the ozone stage and the exit of the chlorine dioxide stage emerged, while final brightness was maintained at target levels with only about 1.5 ppt $ClO_2$ added to brightening stage charge.

The results demonstrate that mill brightness-targets were met during the trial period without a major increase in the $ClO_2$ requirement. Significantly higher chlorine dioxide stage viscosity values (0.5 to 1.5 mPa.s higher) were reported and represent an increase of about 10 to 30% in tear factor. Furthermore, the viscosity-strength relationship had not changed with the implementation of the hot water extraction stage. Thus, the increase in viscosity observed in the pulp translated into a significant strength increase for paper products produced by that pulp.

A cost analysis of implementing these changes revealed a substantial cost benefit of about 3%. At 575 ADT/D for 300 D/year, the savings based on these changes amount to about $135,000/year, again with no detrimental effect on the strength or brightness of the bleached pulp.

Evidence of an additional positive effect was observed. The tendency to scale at the pulp washer downstream of the ozone stage decreased during the trial. Washing the ozonated pulp with the lower pH fluid (the hot water wash filtrate is about one pH unit lower) or the increase in the ozone-receiver tank pH to about 8.5 for better pH-control apparently changed the kinetics of scaling or the kinetics of calcium-salt crystal formation, thus decreasing the extent of scale formation on the wire of the ozonated pulp washer.

Example 3

A pulp bleaching sequence incorporating the use of ozone had been implemented on a 1000 ADTPD commercial scale. The bleaching sequence is an $O_mZ_mE_oD$ sequence which incorporates full countercurrent flow of effluents from the $E_o$ stage back through brownstock washing and ultimately to the liquor recovery system. As described above and in U.S. Pat. No. 5,164,043, the $O_m$ and $E_o$ stages are operated under alkaline conditions (pH 10–12), and the $Z_m$ stage is operated under acidic conditions (pH 2–3).

When full countercurrent flow of effluents is practiced, it has been observed that substantial scaling primarily in the form of calcium oxylates occurs in the post-oxygen washing equipment, particularly in the wash water inlets. The extent of scaling required cleaning of the equipment on a regular basis to maintain an operable process, even when an anti-scaling additive (Betz CSC 845) was added to the process.

The process was modified by making the dilution tank alkaline (a pH of about 8–9), and by changing the alkaline extraction stage to a hot water extraction stage. This was done by eliminating the caustic and oxygen streams to the extraction vessel and by adding steam to raise the water temperature by about 20 degrees. The washer effluent streams were countercurrently recycled in the same manner as the conventional process. The increase in extraction stage temperature was intended to improve lignin removal and consequently reduce the chemical demand in the brightening stage. Surprisingly, the scaling problem was reduced significantly and brought under control so that the plant could be operated without periodic shutdowns for scale removal.

Figure 5:
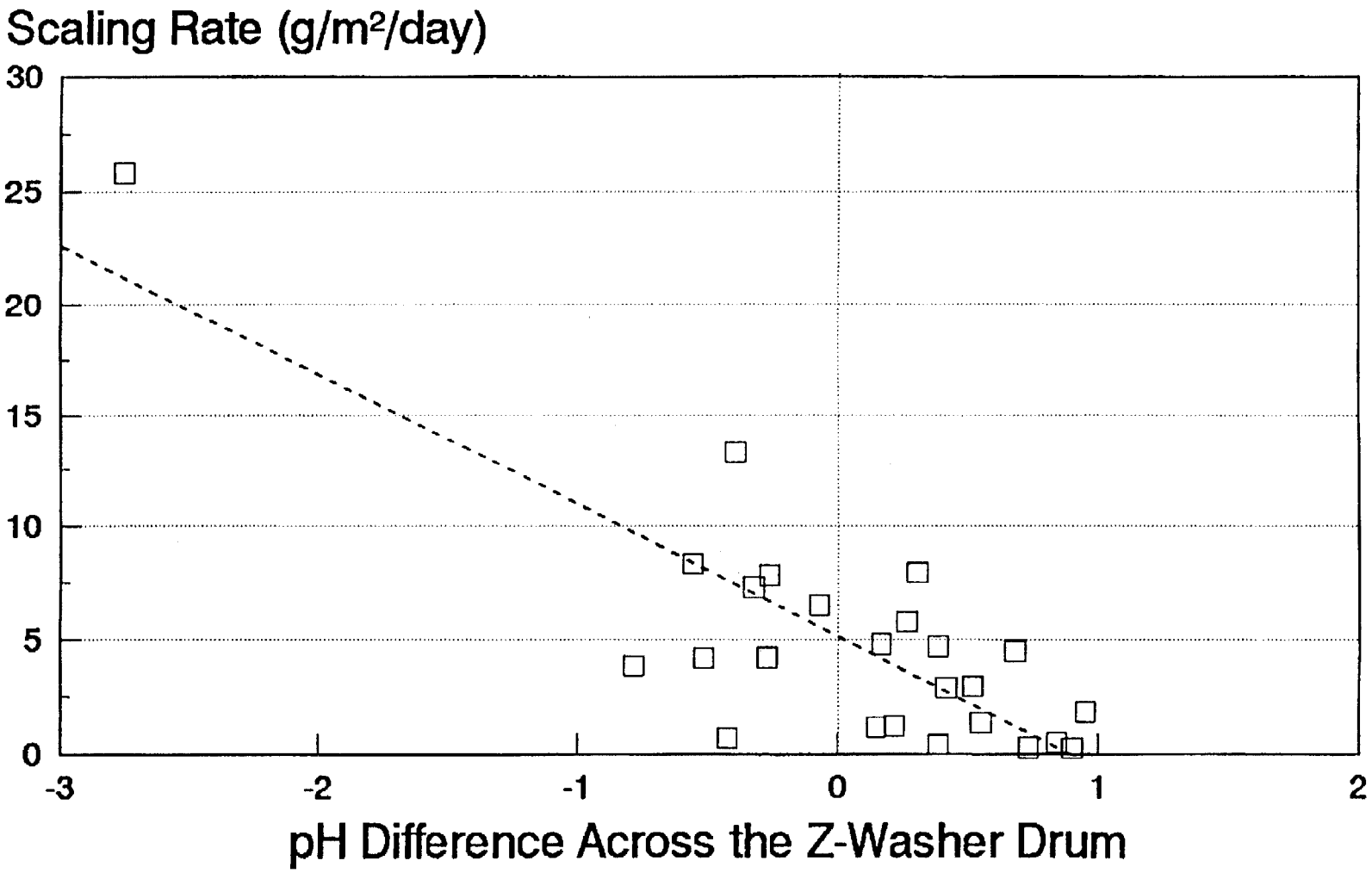
FIGS. 5 and 6 are graphs of the scaling rate vs. pH or pH difference for test coupons which are placed in the ozone washer vat.
Figure 6:
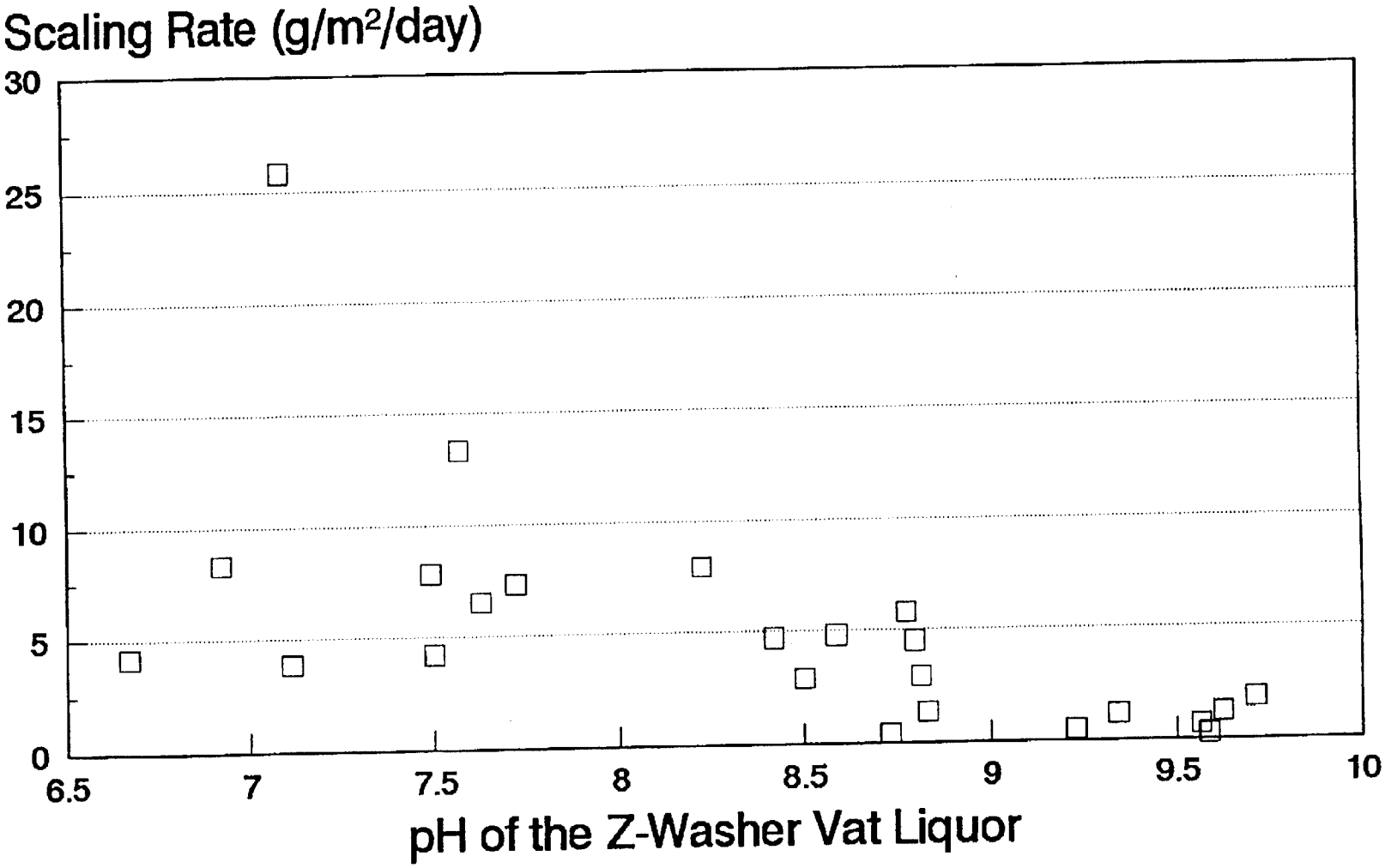

Commercial test coupons were placed in the washer vat for the washer downstream of the ozone reactor as well as in the washer vat for the washer downstream of the extraction stage to monitor the scaling rates in those locations. The coupons were monitored on a weekly basis, and were removed and examined to determine scaling rates. A visual determination of the amount of scaling on the equipment surfaces was also made when the coupons were removed. The results are shown in FIGS. 4–6.

Figure 4:
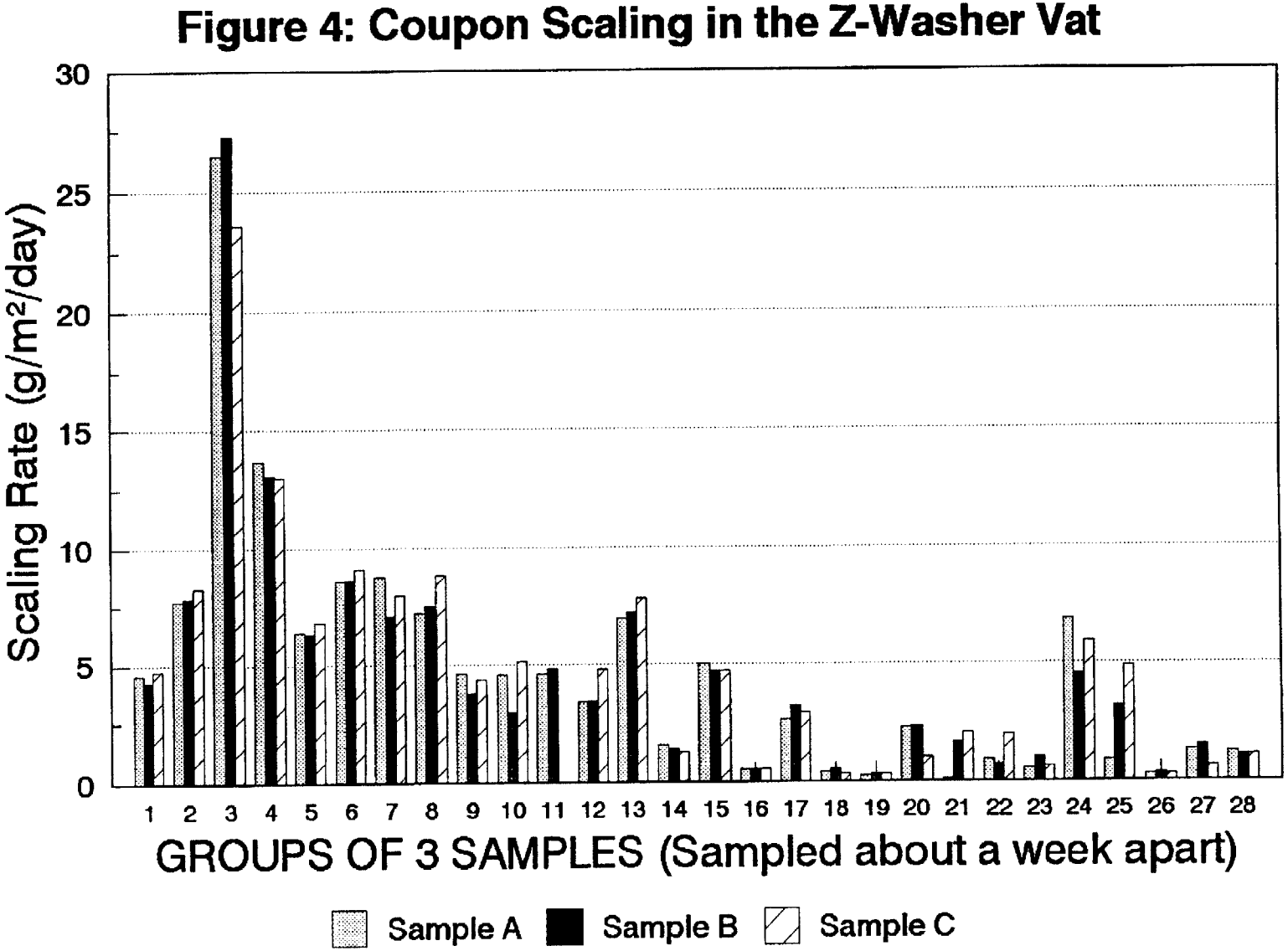
FIG. 4 is a graph of the scaling rate of test coupons over time to illustrate the amount of scale that forms on coupons placed in the washer vat downstream of an ozone delignification stage.

FIG. 4 shows the effect of pH and anti-scaling additive on the scaling rate of three coupons in the washer vat which is downstream of the ozone stage. Most sampling periods were conducted while the post-ozone stage washer vat was operated at a pH of 7.5 with 0.76 pounds per air dried ton of the CSC 845 anti-scaling additive. Sampling periods 14–16 used a pH of 9 while sampling periods 17–28 used a pH of 9.5. The data shows that a decrease in the pH of the water in the extraction stage to 7.5 significantly reduced the formation of scale on the coupons, and that an increase to a pH of 9 or 9.5 in the ozone stage washer vat provided even better results, i.e., lower scaling.

Sampling period 3 was conducted after an oxidative alkaline extraction at a pH of about 12 and 0.45 lbs./ton of CSC 845 added to the system. The results shows that greater scaling was experienced because of the imbalance between the wash water pH and the acidic pulp stream pH.

In sampling periods 19–28, fresh caustic was changed to oxidized white liquor to substantially reduce operating costs, but this had no significant effect on the scaling rate. In sampling periods 20, 24 and 25, the slightly increased scaling rate was attributed to muddy oxidized white liquor carryover.

Sampling periods 2–4 utilized differing amounts of the CSC 845 additive: periods 2 and 3 used 0.45 lbs./ton, while period 4 used 1.31 lbs./ton. Moreover, sampling periods 22–28 did not use any CSC 845 additive. The results show that the amount of the additive used did not significantly affect the scaling rate but that the pH variation was a much more important factor. The discontinued use of the anti-scaling additive had no effect on equipment performance, since the scale that was formed was primarily calcium carbonate due to muddy oxidized white liquor, rather than calcium oxalate, the former being less of a problem during operation.

FIG. 5 shows that a pH difference of 0 or greater across the washer vat for the ozone delignified pulp produces the least scaling rate. FIG. 6 shows that pH alone is not the key parameter, but that it is the pH difference between the water washing the pulp and that of the pulp stream.

The present invention also unexpectedly enhances the strength of the pulp without sacrificing brightness. During a typical production run using an $E_o$ stage following the ozone stage, it was found from an average of 16 samples that the pulp K no. was decreased by 0.5 units (from 4.1 to 3.6) across the $E_o$ stage while the brightness was increased by about 2.7 units to 54.2 GEB and the viscosity was reduced by 0.3 units (from 8.9 to 8.6). The substitution of a hot water soak for the $E_o$ stage for 8 samples showed the same decrease in K No. (0.5 units from 3.8 to 3.3) but with a brightness increase of 1.1 units to 53.9 GEB and no change in the viscosity of the pulp. Accordingly, the pulp strength was retained across the hot water soak stage whereas the strength of the pulp across the $E_o$ stage was decreased. As the amount of brightening chemicals depends upon the K No. of the pulp, and since the K No. of the pulp after the hot water soak is lower than that of the pulp after the $E_o$ stage, lesser amounts are needed for the same increase in brightness, or a slightly greater amount can be used to make up for the lower brightness of the pulp after the hot water soak. Thus, the same final brightness value can be achieved at essentially the same cost of bleaching chemicals, but with an increased strength pulp as a result. More importantly, the scaling rate for the test using the $E_o$ stage was about 27 g/m$^2$ while for the process utilizing the hot water soaking stage, it was at the most only about 12 g/m$^2$. Thus, a much lower possibility of scaling occurs when the hot water soak of the present process is included in place of an alkaline extraction stage.

When considering strength alone, one would not want to utilize any alkaline materials in the extraction stage so as to retain the highest strength. This requires much greater amounts of brightening chemicals in the final brightening step or steps. Even so, the pulp will not be as bright as when alkaline extraction stages are used. In comparison, when brightness of the pulp is considered, lots of alkaline material should be used to remove as much lignin as possible so that the brightening chemicals can whiten the pulp to the greatest brightness values. In this process, however, the strength of the pulp is significantly reduced due to viscosity degradation. The present invention provides a compromise between these two positions in that a reasonable strength of the pulp is retained (i.e., less viscosity degradation compared to alkaline extractions) while still allowing the pulp to achieve the high brightnesses required for certain applications involving high quality paper. This is achieved by controlling the time of exposure of the pulp to alkaline materials and by utilizing the hot water soaking stage to remove contaminants which would consume chemicals in the brightening stage.

Accordingly, the use of pH control and the hot water extraction stage of the present invention provides a number of unexpected advantages compared to similar processes that instead use an alkaline extraction stage. These advantages include:

(1) a pulp strength, measured by pulp viscosity, which is higher than the conventional pulp, without any reduction of final pulp brightness. This is believed to be due to the use of lesser concentrations of alkaline material for shorter times in the present process, compared to conventional processes which include the alkaline extraction stage.

(2) a significant cost advantage for operation of the present process. This is primarily due to the use of less expensive alkaline material sources such as oxidized white liquor rather than fresh caustic, which is possible because of the hot water extraction step.

(3) a significant reduction of calcium oxylate scale formation in the washer downstream of the ozone reactor due to the control of the pH values of the wash and process streams.

(4) the elimination of an anti-scaling additive to the present process due to the successful reduction of scale using pH control.

The present invention should be applicable to any process wherein the effluent from the washing of pulp which has been subjected to a subsequent lower pH pulp treatment is recycled to a preceding higher pH pulp treatment step in order to prevent the formation of salt precipitates and the resultant scale formation. For example, when acidic pulp treatments other than ozone are used, the effluents from those treatments could be handled in essentially the same manner as the acidic filtrates of the preferred ozone treatment.

What is claimed is:

1. A method for reducing or eliminating the formation of salt scale upon process equipment in a pulp bleaching process due to pH shock caused by the presence of sparingly soluble salts, which comprises:

subjecting the pulp to a bleaching sequence which includes a plurality of pulp treatment steps, wherein at least one pulp treatment step is conducted under acidic conditions to generate an acidic pulp stream;

adding caustic material to the acidic pulp stream prior to the washing step to generate an increased pH pulp stream having a pH of up to 11.5;

optionally adjusting the consistency of the increased pH pulp stream to facilitate transport to subsequent pulp treatment steps; and washing the increased pH pulp stream in a washing stage with an aqueous wash solution having a pH which is lower than that of the increased pH pulp stream to avoid pH shock and to remove at least some of said salts therefrom to thereby reduce or eliminate the formation of salt scale upon process equipment used for conducting one or more subsequent pulp treatment steps.

2. The method of claim 1 wherein the caustic material is added to the acidic pulp stream as an alkaline solution in an amount effective to generate a pulp stream having a neutral to alkaline pH.

3. The method of claim 1 wherein the aqueous wash solution has a pH which differs from that of the pulp stream by no more than about 5 units.

4. The method of claim 1 wherein the aqueous wash solution has a pH which differs from that of the pulp stream by about 2 units or less.

5. The method of claim 1 wherein the pH of the increased pH pulp stream is at least about 8 and the pH of the aqueous wash solution is about 7.

6. The method of claim 1 wherein the caustic material is added to the acidic pulp stream under conditions effective to remove at least a portion of the lignin remaining in the pulp while not significantly reducing the strength of the pulp.

7. The method of claim 6 wherein the caustic material is added to the pulp stream to provide a pH of less than 10 and for no longer than about 30 to 60 minutes before the pulp stream is washed at a pulp stream temperature of no greater than about 165° F.

8. The method of claim 6 which further comprises soaking the washed pulp to remove additional lignin therefrom prior to subjecting the pulp to a subsequent brightening treatment step.

9. The method of claim 8 wherein the caustic material is oxidized white liquor and the soaked pulp is washed to remove contaminants which would otherwise affect the efficiency of the brightening treatment step.

10. The method of claim 1, wherein the pulp bleaching sequence includes an ozone delignification stage followed by a brightening stage, and the method further comprises treating as the acidic pulp stream the pulp exiting the ozone delignification stage with an alkaline solution having pH above 7 for a sufficient time and at a temperature of at least about 60° F. to form the increased pH pulp stream, followed by treating the increased pH pulp stream with the aqueous wash solution before the pulp stream enters the brightening stage.

11. The method of claim 10 wherein the sequence comprises forming the pulp from a lignocellulosic material and increasing the brightness of the ozone delignified pulp in a brightening stage to obtain a pulp which is brightened to essentially the same brightness as a pulp which is subjected to the same sequence except where an alkaline extraction stage is used instead of the aqueous solution treatment.

12. The method of claim 10 wherein the increased pH pulp stream has a pH of about 7.5 to 11.5 and a temperature of about 90° to 125° F. for about 1 to 15 minutes.

13. The method of claim 11 wherein the brightening stage uses a brightening agent in an amount which is increased by up to about 20% compared to the sequence that utilizes an alkaline extraction stage.

14. The method of claim 10 wherein the aqueous solution has a pH of about 5 to 9 and a temperature of about 100° to 200° F.

15. The method of claim 10 wherein oxidized white liquor is utilized for at least a portion of the alkaline solution.

16. The method of claim 10 wherein the pH of the pulp stream is at least about 0.5 to 2 units higher than that of the aqueous solution, and the temperature of the aqueous solution treatment is at least about 10° to 20° F. higher than that of the pulp stream.

17. The method of claim 10 which further comprises washing the pulp after alkaline solution treatment, washing the pulp after the aqueous solution treatment, and recycling at least some of the effluent from the latter washing step to the former.

18. The method of claim 17 which further comprises partially delignifying the pulp with oxygen, washing the pulp, and acidulating the pulp prior to the ozone delignification stage, wherein at least some of the effluent from the washing of the pulp after the alkaline treatment is used for washing the pulp after the oxygen delignifying step.

19. The method of claim 10 wherein the ozone delignification stage is conducted on high consistency pulp and the brightening stage is conducted using a peroxide compound or chlorine dioxide.

20. The method of claim 10 wherein sufficient caustic is added to the increased pH pulp stream to raise the pH to no greater than 9.5, and the aqueous solution has a pH of no greater than about 7.5.

21. The method of claim 1 wherein sufficient caustic is added to the increased pH pulp stream to raise the pH to no greater than 9.5, and the aqueous wash solution has a pH of no greater than about 7.5.

* * * * *